US008465383B2

(12) United States Patent
Nally

(10) Patent No.: US 8,465,383 B2
(45) Date of Patent: Jun. 18, 2013

(54) SPORTS NET ASSEMBLY

(75) Inventor: Michael J. Nally, Ridgewood, NJ (US)

(73) Assignee: Eastpoint Sports Ltd., LLC, Whippany, NJ (US)

( * ) Notice: Subject to any disclaimer, the term of this patent is extended or adjusted under 35 U.S.C. 154(b) by 226 days.

(21) Appl. No.: 13/098,431

(22) Filed: Apr. 30, 2011

(65) Prior Publication Data

US 2012/0277037 A1 Nov. 1, 2012

(51) Int. Cl.
*A63B 61/02* (2006.01)
*A63B 61/04* (2006.01)

(52) U.S. Cl.
USPC ..... 473/493; 473/494

(58) Field of Classification Search
USPC ..... 473/490–495
See application file for complete search history.

(56) References Cited

U.S. PATENT DOCUMENTS

| | | | | |
|---|---|---|---|---|
| 3,105,682 | A * | 10/1963 | Ahrens | 482/17 |
| 5,651,552 | A * | 7/1997 | Whelchel | 473/494 |
| 5,951,417 | A * | 9/1999 | Ha | 473/493 |
| 6,089,995 | A * | 7/2000 | Schroeder | 473/469 |
| 7,037,221 | B2 * | 5/2006 | Bouffard et al. | 473/492 |
| 7,223,187 | B1 * | 5/2007 | Bouffard et al. | 473/492 |
| 7,455,603 | B2 * | 11/2008 | Bouffard et al. | 473/492 |
| 2011/0224031 | A1 * | 9/2011 | Underwood | 473/492 |
| 2012/0277037 | A1 * | 11/2012 | Nally | 473/493 |

* cited by examiner

*Primary Examiner* — Raleigh W Chiu
(74) *Attorney, Agent, or Firm* — Thomas J. Oppold; Larkin Hoffman Daly & Lindgren, Ltd.

(57) ABSTRACT

A sports net assembly and method of assembling a sports net assembly. The sports net assembly includes a pair of poles spaced a distance apart and positioned substantially vertically. A net having opposing ends is positioned between the spaced apart substantially vertical poles. The top net cord is secured to a cam that is slidably movable along a length of the poles to increase and decrease the tension on the top net cord thereby increasing and decreasing sag in the net between the poles. The bottom net cords and guy-ropes may be releasably secured to the poles with a key lock.

14 Claims, 2 Drawing Sheets

SPORTS NET ASSEMBLY

BACKGROUND

Nets used for backyard or recreational badminton, volleyball and other net-sports can be burdensome and time consuming to initially set up because it typically requires the user to attach eyebolts or brackets with eyelets to the support poles and then tie the top and bottom net cords to the eyes. Additionally, when it comes time to take down the net, many users find it too time consuming and burdensome to untie the knots to remove the net from the poles and so they simply role the whole net assembly up around the poles. By not removing the net from the poles, the net becoming tangled with the guy-ropes other net components or the net will become entangled with other items where the net is stored thereby making it more burdensome and time consuming to set up the net the next time it is desired to be used.

Accordingly, there is a need for a sports net assembly that simplifies the initial set and subsequent set ups of the net and which makes it just as simple to disassemble the net after game play so as not to discourage users from completely disassembling the net from the support poles for proper storage. Additionally it is desirable to incorporate into the sports net assembly a simple and effective way to adjust and maintain the desired tension on the net during game play.

DESCRIPTION

Figure 1:
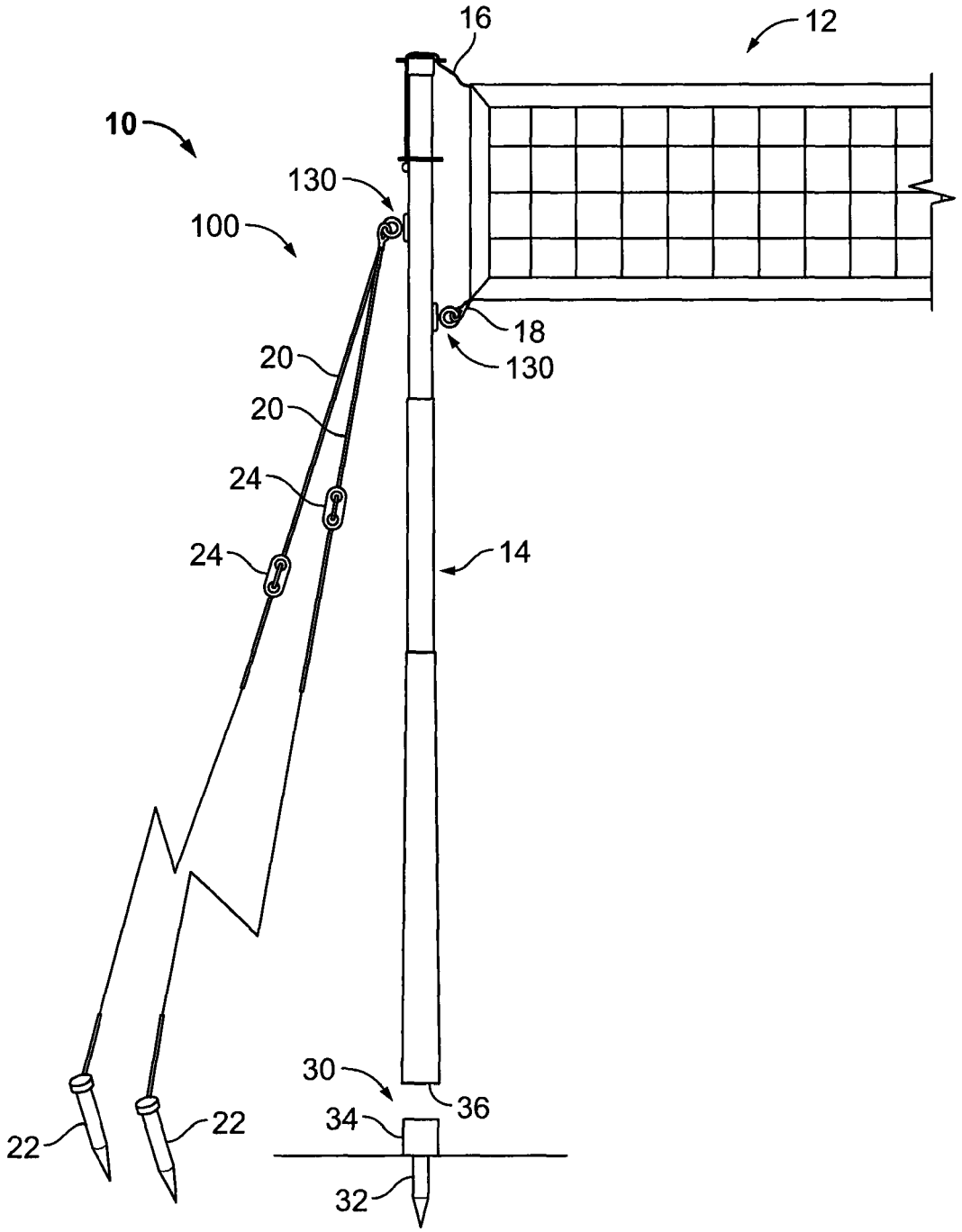
FIG. 1 is an elevation view of an embodiment of a sports net assembly with an embodiment of a net attachment and tensioning system.

Referring now to the drawings, wherein like reference numerals designate identical or corresponding parts throughout the several views, FIG. 1 illustrates an embodiment of one side of a sports net assembly 10, it being understood that the other side is a mirror image of the side illustrated in FIG. 1.

The sports net assembly 10 includes a net 12 operably supported between spaced apart support poles 14 by a top net cord 16 and a bottom net cord 18 utilizing the net attachment and tensioning system 100 (discussed later). Guy-ropes 20 are provided to stabilize and hold the poles 14 so the net remains in place during game play and to resist the tendency of the poles to tip inwardly under the weight of the net 12. The guy-ropes 20 are secured at one end to the ground by stakes 22. The other end of the guy-ropes 20 are preferably releasably attached to the poles 14 as described later. Length adjusters 24, as are well known in the art, may be provided to allow the user to adjust the length of the guy-ropes 20 as desired to adjust and plumb the poles and/or to increase or decrease tension or pull on the net 12 to reduce sag in the net between the poles.

The poles 14, may comprise a single pole or a number of pole sections which fit together. The poles 14 are preferably thin-walled tubular members such that the poles are light weight yet sufficiently rigid to adequately support the net without buckling. The cross-section of the tubular members may be round, square or other shape to provide the desired rigidity. In a preferred embodiment, the poles 14 include a ground member 30 having a pointed end 32 that is hammered into the ground as an anchor for the poles. A pole receiving end 34 of the ground member 30 preferably projects a distance above the ground to be telescopically received by the bottom end 36 of the tubular pole member. The ground engaging member 30, is preferably configured and made of a material that can withstand repeated hammering without the pole receiving end 34 mushrooming or becoming deformed.

Figure 2:
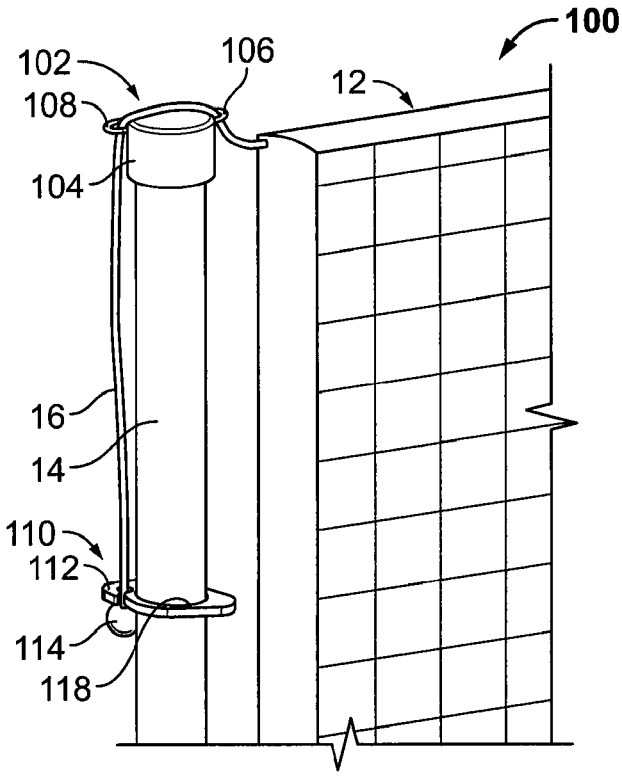
FIG. 2 is an enlarged perspective view of a portion of the net attachment and tensioning system of FIG. 1 showing an embodiment of a pole cap and cam for supporting and tensioning the top net cord.
Figure 5:
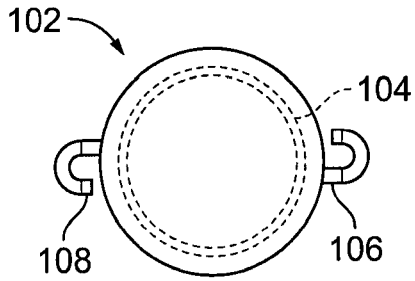
FIG. 5 is a plan view of an embodiment of a pole cap.

The net attachment and tensioning system 100 preferably includes a pair of pole caps 102. Each pole cap 102 preferably includes a pole receptacle 104 which receives or sits over the top end of each pole 14 or is otherwise secured proximate the top end of each pole. The pole cap 102 has first and second hooks 106, 108 through which a length of the top net cord 16 passes as best illustrated in FIGS. 2 and 5.

Figure 4:
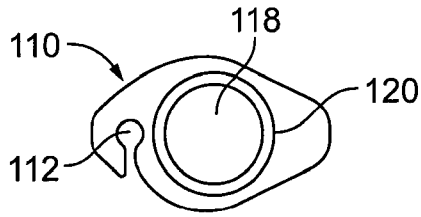
FIG. 4 is a plan view of an embodiment of a cam for the net attachment and tensioning system of FIG. 1.

The net attachment and tensioning system 100 also preferably includes a cam 110 that is slidably disposed along the pole 14. The cam 110 includes a slot 112 into which the top net cord 16 is removably receivable. A ball or knot 114 is preferably provided at the end of the top net cord 16 to prevent the top net cord from pulling through the slot 112. The cam 110 includes an aperture or opening 118 (FIG. 4) that is preferably slightly larger than, but complimentary to, the outer periphery of the pole 14 so that when the cam 110 is positioned so that it is in a plane substantially perpendicular to, or normal to the pole 14, the cam 110 will freely slide up and down along the pole. However, because the aperture 118 is preferably only slightly larger than the outer periphery of the pole, if the cam is angled or canted, the aperture walls 120 (FIG. 4) will make contact with the pole 14 and the frictional resistance between the aperture walls 120 with the pole 14 will cause the cam 110 to frictionally lock relative to the pole until it is again positioned in the slidable position where it is in a plane substantially perpendicular or normal to the pole. Accordingly, as illustrated in FIG. 2, the net attachment and tensioning assembly provides a simple and effective way to adjust and maintain the desired tension on the net during game play by simply sliding the cams 110 down relative to the top end of the poles 14. This downward movement of the cam 110 will result in an increase in tension or pull on the top net cord 16 which will reduce net sag. To easily disassemble the net from the poles, the cam 110 is moved upward along the pole 14 to decrease tension on the net cord 16 so the cord can be easily removed from the slot 112. The length of the top net cord 16 can then be removed from the hooks 106, 108 on the pole cap 102 freeing the top net cord 16 from the poles 14.

In a preferred embodiment, the cam 110 is preferably made of a substantially rigid material so that it will not bend or deform under the pulling force or tension exerted by the top net cord 16 received within the slot 112. It is also preferred that the aperture walls 120 are made of material with a high friction factor, such as rubber to provide a better frictional lock to resist sliding of the cam relative to the pole. To provide the desired rigidity while at the same time providing the desired high friction rubber material at the aperture walls 120, the cam 110 is preferably fabricated using a double injection molding process wherein the body of the cam is made of plastic or other suitably rigid material while the aperture walls are made of rubber or other high friction factor material.

Figure 3:
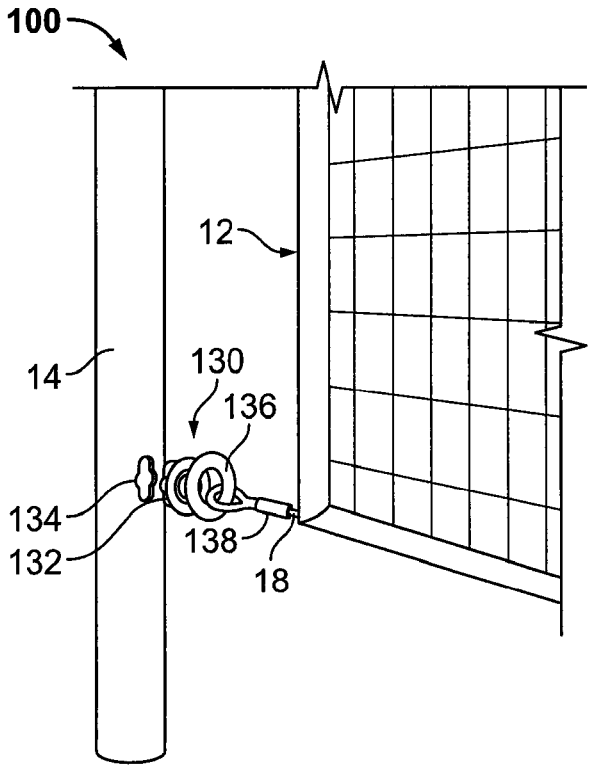
FIG. 3 is an enlarged perspective view of a portion of the net attachment and tensioning system of FIG. 1 showing an embodiment of a key lock for releasably securing the bottom net cord to the pole.
Figure 6:
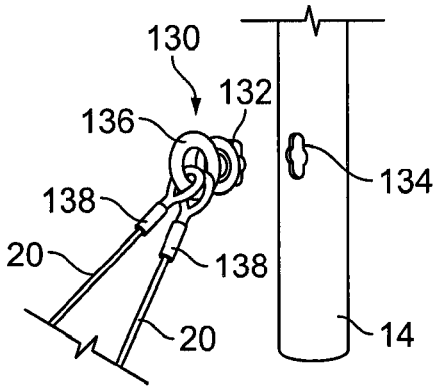
FIG. 6 is an enlarged perspective view of a portion of the net attachment and tensioning system of FIG. 1 showing an embodiment of a key lock for releasably securing guy-ropes to the pole.

Referring to FIGS. 3 and 6, the net attachment and tensioning system 100 also preferably includes key locks 130 for securing the bottom net cord 18 and guy-ropes 30 to the poles 14. The key locks 130 include keys 132 that cooperate with mating pre-drilled key holes 134 in the poles 14. Each key 132 preferably includes an eyelet 136 to which the bottom net cord 18 or guy-ropes 20 are attached. The other end of each key 132 preferably has an elongated shape that is receivable by the mating pre-drilled key hole 134 such that when the key 132 is inserted into the key hole 134 and partially twisted or rotated, the elongated shape of the key 132 will not pull through the key hole 134. The pre-drilled key holes 134 ensure that the bottom net cord 18 and guy-ropes 20 are attached in the proper position. The net bottom cord 18 and guy-ropes 20 are preferably securely fixed to the eyelets 136 of the keys 132 in a pre-assembled manner at the factory, such as by use of a clamp 138 forming a loop around the eyelet 136, so that the user does not have to bother with tying the cords 18 or guy-ropes 20 to the keys 132 during the initial set-up of the net.

It should be appreciated that the foregoing net attachment and tensioning system 100 simplifies the attachment of the net and guy-ropes to the poles during initial set-up and makes the disassembly of the net and guy-ropes from the poles just as easy and efficient so users are not discouraged from completely disassembling the net and guy-ropes from the poles during take-down of the net after game play. As such, each subsequent set-up of the net follows the same simple procedure as the initial set up. Furthermore, the net attachment and tensioning assembly 100 provides a simple and effective way to adjust and maintain the desired tension in the net during game play by simply sliding the cams 110 up and down relative to the poles 14.

The foregoing description is presented to enable one of ordinary skill in the art to make and use the invention and is provided in the context of a patent application and its requirements. Various modifications to the preferred embodiment of the apparatus, and the general principles and features of the system and methods described herein will be readily apparent to those of skill in the art. Thus, the present invention is not to be limited to the embodiments of the apparatus, system and methods described above and illustrated in the drawing figures, but is to be accorded the widest scope consistent with the spirit and scope of the appended claims.

The invention claimed is:

1. A sports net assembly, comprising:

a pair of poles spaced a distance apart and positioned substantially vertically;

a net having opposing ends positioned between said spaced apart poles, each of said net opposing ends having a length of a top net cord and a length of a bottom net cord extending therefrom;

a pair of cams, each slidably movable along a respective one of said poles, said length of said top net cord extending from said opposing ends of said net releasably secured to each of said cams, each of said cams further having an aperture slightly larger than and complimentary to an outer periphery of a portion of said pole along which said cam is slidably movable;

whereby when said cam is positioned in a plane substantially perpendicular to said pole, said cam is slidably movable along said pole, but when said cam is positioned in a plane that is not substantially perpendicular to said pole, walls of said aperture frictionally engage with said pole outer periphery, thereby frictionally locking said cam with respect to said pole; and whereby movement of said cams downwardly along said poles increases tension on said top net cord so as to reduce sag in said net.

2. The sports net of claim 1 wherein said aperture walls include rubber material.

3. The sports net of claim 1 further comprising key locks for securing said opposing lengths of said bottom net cord to each of said poles, each of said key locks comprising a key having an end to which said length of said net bottom cord is secured, another end of said key receivable within a complimentary key hole wherein rotation of said key relative to said key hole removably secures said key to said pole such that said bottom net cord is operably secured to said poles.

4. The sports net of claim 1 further comprising a key lock for securing a guy-rope to said poles, wherein said key lock comprises a key having an end to which said guy-rope is secured, another end of said key receivable within a complimentary key hole wherein rotation of said key relative to said key hole removably secures said key to said pole.

5. The sports net of claim 1 further comprising a pair of pole caps, each disposed proximate said top end of each of said poles, each of said pole caps operably supporting said length of said top net cord extending from said opposing ends of said net.

6. The sports net of claim 5 wherein said pole cap includes a first hook through which said length of said top net cord passes.

7. The sports net of claim 5 wherein said pole cap includes first and second hooks through which said length of said top net cord passes.

8. A method of assembling a sports net assembly, said method comprising:

spacing a pair of poles a distance apart and substantially vertically;

positioning a net having opposing ends between said spaced apart substantially vertical poles, each end of said net having a length of a top net cord and a length of a bottom net cord extending therefrom;

releasably securing said lengths of said top net cord to a cam on each of said poles, each of said cams having an aperture slightly larger than and complimentary to an outer periphery of a portion of said pole whereby when said cam is positioned in a plane substantially perpendicular to said pole, said cam is slidably movable along said pole, but when said cam is positioned in a plane that is not substantially perpendicular to said pole, walls of said aperture frictionally engage with said pole outer periphery to resist movement thereof;

slidably moving said cam on each said poles downwardly along said pole to increase tension on said top net cord so as to reducing sag in said net between said poles;

releasably securing said length of said bottom net cords to said poles.

9. The method of claim 8 wherein said aperture walls include rubber material.

10. The method of claim 8 wherein said step of releasably securing said bottom cords to said poles includes the steps of:

inserting a key secured to an end of each of said lengths of said bottom net cords into a key hole pre-drilled into said pole, said key hole having a complimentary shape to said key;

rotating said key relative to said key hole such that said key cannot be withdrawn from said key hole unless rotated to re-align said complimentary shapes of said key and said keyhole.

11. The method of claim 8 further comprising:

releasably securing a guy-rope to each of said poles, including inserting a key secured to an end of said guy-rope into a key hole pre-drilled into said pole, said key hole having a complimentary shape to said key;

rotating said key relative to said key hole such that said key cannot be withdrawn from said key hole unless rotated to re-align said complimentary shapes of said key and said keyhole.

12. The method of claim 8 wherein each of said poles includes a pole cap, each pole cap disposed proximate said top end of each of said poles, each of said pole caps operably supporting said length of said top net cord extending from said opposing ends of said net.

13. The method of claim 12 wherein said pole cap includes a first hook through which said length of said top net cord passes.

14. The method of claim 12 wherein said pole cap includes first and second hooks through which said length of said top net cord passes.

* * * * *